US005813315A

United States Patent [19]

Kristensen et al.

[11] Patent Number: 5,813,315

[45] **Date of Patent: *Sep. 29, 1998**

[54] HYDRAULIC PISTON MACHINE HAVING SHEATHING PLASTIC MATERIAL FOR REDUCING FRICTION

[75] Inventors: Egon Kristensen, Nordborg; Lars Martensen; Sten Jensen Olesen, both of Sønderborg, all of Denmark

[73] Assignee: Danfoss A/S, Nordborg, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 765,511

[22] PCT Filed: Jun. 30, 1995

[86] PCT No.: PCT/DK95/00277

§ 371 Date: Dec. 27, 1996

§ 102(e) Date: Dec. 27, 1996

[87] PCT Pub. No.: WO96/02756

PCT Pub. Date: Feb. 1, 1996

[30] Foreign Application Priority Data

Jul. 13, 1994 [DE] Germany ..... 44 24 610.2

[51] Int. Cl.[6] ..... F04B 1/20; F03C 1/06

[52] U.S. Cl. ..... 92/71; 417/269

[58] Field of Search ..... 92/71; 417/269, 417/222.1

[56] References Cited

U.S. PATENT DOCUMENTS

| | | | |
|---|---|---|---|
| 3,183,848 | 5/1965 | Raymond | 417/269 |
| 3,453,965 | 7/1969 | Heinrich | 91/499 |
| 4,617,856 | 10/1986 | Miller et al. | 417/269 X |
| 5,017,095 | 5/1991 | Burgess et al. | 417/269 X |
| 5,601,009 | 2/1997 | Jepsen et al. | 417/269 |
| 5,685,215 | 11/1997 | Jepsen et al. | 417/269 |

*Primary Examiner*—Timothy Thorpe
*Assistant Examiner*—Ted Kim
*Attorney, Agent, or Firm*—Lee, Mann, Smith McWilliams, Sweeney & Ohlson

[57] ABSTRACT

A hydraulic piston machine is disclosed, having a cylinder body, which has at least one cylinder, in which a piston is arranged to move back and forth and bears by way of a slide shoe against a control surface, and having a pressure plate which holds the slide shoe in engagement with the control surface. It is desirable to be able to operate such a machine also with a fluid that has no or only poor lubricating properties. To that end, the pressure plate and/or the control surface is provided with a layer of a friction-reducing plastics material at least in one of the regions with which in operation they rub against other parts.

10 Claims, 2 Drawing Sheets

HYDRAULIC PISTON MACHINE HAVING SHEATHING PLASTIC MATERIAL FOR REDUCING FRICTION

This application is a 371 of PCT/DK95/00277, filed Jun. 30, 1995.

BACKGROUND OF THE INVENTION

The invention relates to a hydraulic piston machine having a cylinder body, which has at least one cylinder, in which a piston is arranged to move back and forth and bears by way of a slide shoe against a control surface, and having a pressure plate which holds the slide shoe in engagement with the control surface.

Such a hydraulic machine can operate according to the axial piston principle or according to the radial piston principle. In both cases the movement of the piston is controlled by way of a control surface on which the slide shoe lies and over which it is guided on movement of the cylinder body. Since the slide shoes have to be held constantly in engagement with the control surface, the pressure plate has to perform corresponding back and forth movements, for example, pivoting movements, with respect to the cylinder body. This causes a certain amount of friction when the pressure plate is mounted opposite the cylinder body. There is a further region of friction where the slide shoes bear against the pressure plate. There, the relative movement is not as pronounced, but nevertheless still exists. Finally, the slide shoes slide over the control surface, so that here too there is a certain amount of friction.

This friction was not critical provided that the hydraulic fluids used had lubricating properties at the same time. Such hydraulic fluids are formed, for example by oils. Synthetic oils that have been specifically developed for hydraulic machines have especially good properties. However, these synthetic oils have the serious drawback that they are often toxic and are able to escape in the event of the machine being damaged, or even in operation, which leads to considerable environmental pollution.

SUMMARY OF THE INVENTION

The invention is based on the problem of being able to operate a hydraulic piston machine even with hydraulic fluids which have no or poor lubricating properties, for example, with water.

This problem is solved in a machine of the kind mentioned in the introduction in that the pressure plate and/or the control surface is provided with a layer of a friction-reducing plastics material at least in one of the regions with which in operation they rub against other parts.

The "friction-reducing" property is, of course, always with respect to the material of the counterpart against which the pressure plate or the control surface rubs. In the case of the control surface this is the material of the slide shoe. In the case of the pressure plate it is the material of the slide shoe and the material of a pressure-applying arrangement, for example, in the case of an axial piston machine, a ball-and-socket joint, which biases the pressure plate with force towards the control surface. Suitable plastics material for the layer are in particular materials from the group of high-strength thermoplastic plastics materials based on polyarylether ketones, for example, polyether ether ketones, polyamides, polyacetals, polyaryl ethers, polyethylene terephthalates, polyphenylene sulphides, polysulphones, polyether sulphones, polyether imides, polyamideimide, polyacrylates, phenol resins, such as novolak resins, or similar substances; glass, graphite, polytetrafluoroethylene or carbon, especially in fibre form, can be used as fillers. When using such materials, it is possible to use even water as hydraulic fluid.

Because only a layer of the friction-reducing plastics material is provided, the parts provided with the layer can be adopted virtually unchanged compared with a construction without the layer. The strength in particular can be maintained if the layer is applied to a core of stronger material. The problem of keeping the layer on the core is largely offset in the case of the pressure plate and control surface because both parts have relatively large flat areas to which this layer is able to cling with the necessary reliability. In the case of parts with a more complex geometry, for example, slide shoes, this is also possible, but the effort required for their manufacture is substantially greater.

In a preferred construction, the pressure plate and/or a swash plate having the control surface is sheathed in the plastics material. With such a sheathing, the particular part or the core thereof is completely enclosed by the plastics material. This has the advantage, firstly, that no hydraulic fluid is able to penetrate between the core and the layer, which under adverse conditions could result in the layer becoming partially or completely detached from the core. Secondly, this has the advantage that the connection of the layer to the core is no longer effected by adhesion, but by a form of interlocking engagement. The components of the layer, which extend away from the plane into the third dimension, contribute to the fact that the layer can no longer arbitrarily be displaced on the core. The adhesive forces can thus be kept smaller or made weaker. Conversely, with a given adhesive force the loading of the particular parts can be increased.

The layer is preferably in the form of an injection-moulded part which is injection-moulded onto the pressure plate and the control surface. The particular advantage of using the parts pressure plate and control surface becomes apparent here. Their relatively simple geometric form enables a correspondingly simple injection mould to be made. Manufacture can therefore be effected inexpensively. Part of the costs saved can be used to manufacture the parts with a greater accuracy and/or durability.

The pressure plate is preferably bevelled in the region of its edge on its side facing towards the cylinder body. This measure enables the pressure plate to have a greater strength. As a result of the bevelling, with otherwise unchanged dimensions the pressure plate can be of thicker construction. This in turn leads to the pressure plate being able to accommodate larger forces. The bevelling prevents the pressure plate coming into contact with cylinder drum or abrading it. If the plastics material of the friction-reducing layer is located in this region, the layer could become damaged, which is undesirable and could have further consequential damage. In spite of the reduction in friction by the plastics material, a machine that can be loaded to a relatively extreme degree can therefore be realized using this construction.

It is preferred here for the bevel to commence in the radial direction within a circular ring in which through-openings for receiving the slide shoes are arranged. The bevel thus commences relatively far inwards on the pressure plate, so that the pressure plate as a whole can be of a correspondingly thick construction without this leading to collision with the cylinder drum. The decrease in thickness in an outward direction is less critical, because there is a larger area there for take-up of forces.

It is also preferred for the bevel to commence outside a radius on which the midpoints of the through-openings are arranged. The main point of application of force then still lies in the region in which the pressure plate has its greatest thickness.

The layer preferably has an interlocking connection with the pressure plate and/or the control surface. This interlocking connection is provided in addition to the connection already mentioned above arising from complete sheathing of the core with the layer of friction-reducing plastics material. The additional interlocking connection in particular takes up tensile forces which act at right angles to the friction-reducing layer. Such tensile forces can arise, for example, during machining of the part after the plastics material layer has been applied. Such an instance can occur when the plastics material layer does not lie at all points quite fixedly on the core because of trapped air or the like. In that case, the plastics material layer could be lifted away from the core by a machining process, such as can be effected by milling or grinding. This lifting away may possibly go completely unnoticed during a final inspection because the internal recovery forces of the plastics material are possibly not sufficiently great to bring it back into contact with the core again after lifting away.

During assembly and at the latest during operation, such large forces are then exerted on the plastics material layer that it is pressed back onto the core again. In this condition, however, the machined form is not consistent with the desired form. If there is now an interlocking connection between core and plastics material layer, this lifting away during machining is reliably avoided.

It is especially preferred for the pressure plate and/or the swash plate having the control surface to have a through-opening through which the plastics is taken like a rivet. The layer is then, as it were, fixedly riveted to its respective core. This provides a very stable interlocking connection. Such a rivet is preferably formed in one piece with the layer and is produced most simply by making a corresponding through-bore in the core of the pressure plate or the swash plate before the moulding operation. During moulding, in particular during injection-moulding, this bore is filled with the plastics material and thus automatically produces the desired rivet.

It is also an advantage for the connection to be arranged in the region of the contact surface. It is here that the load is greatest. These regions are normally machined after moulding.

The through-openings are preferably of elliptical shape. The slide shoes have a elliptical orbit during operation. Because of this orbit form, the through-openings in the pressure plate which receive the slide shoes must normally be made relatively large. This impairs stability during operation, however, that is, the slide shoes are not always held firmly on the swash plate with the necessary reliability. Because the through-openings now have an elliptical form, with the the long dimension of the ellipse being radially oriented, the slide shoes are, at least laterally, guided better, with the result that tilting can be better prevented.

The pressure plate preferably has a core with circular bores, the circumferential wall of which is lined with the layer of friction-reducing plastics material to provide the elliptical form, the thickness of the layer varying circumferentially. Normally, it is relatively complicated to make elliptical through-openings. The proposed construction reduces, however, the effort involved in manufacture quite dramatically. Circular bores can continue to be made in the pressure plate. These are simple to make. The elliptical form is then produced during moulding of the plastics material simply by using a corresponding mould. The wall thickness varying circumferentially causes the wall of the through-opening to be weaker in some directions than in other directions, but this is not serious. In return, one gains the advantage that the slide shoes are held more reliably on the control surface.

BRIEF DESCRIPTION OF THE DRAWINGS

The invention is described hereinafter with reference to a preferred embodiment in conjunction with the drawing, in which.

Figure 1:
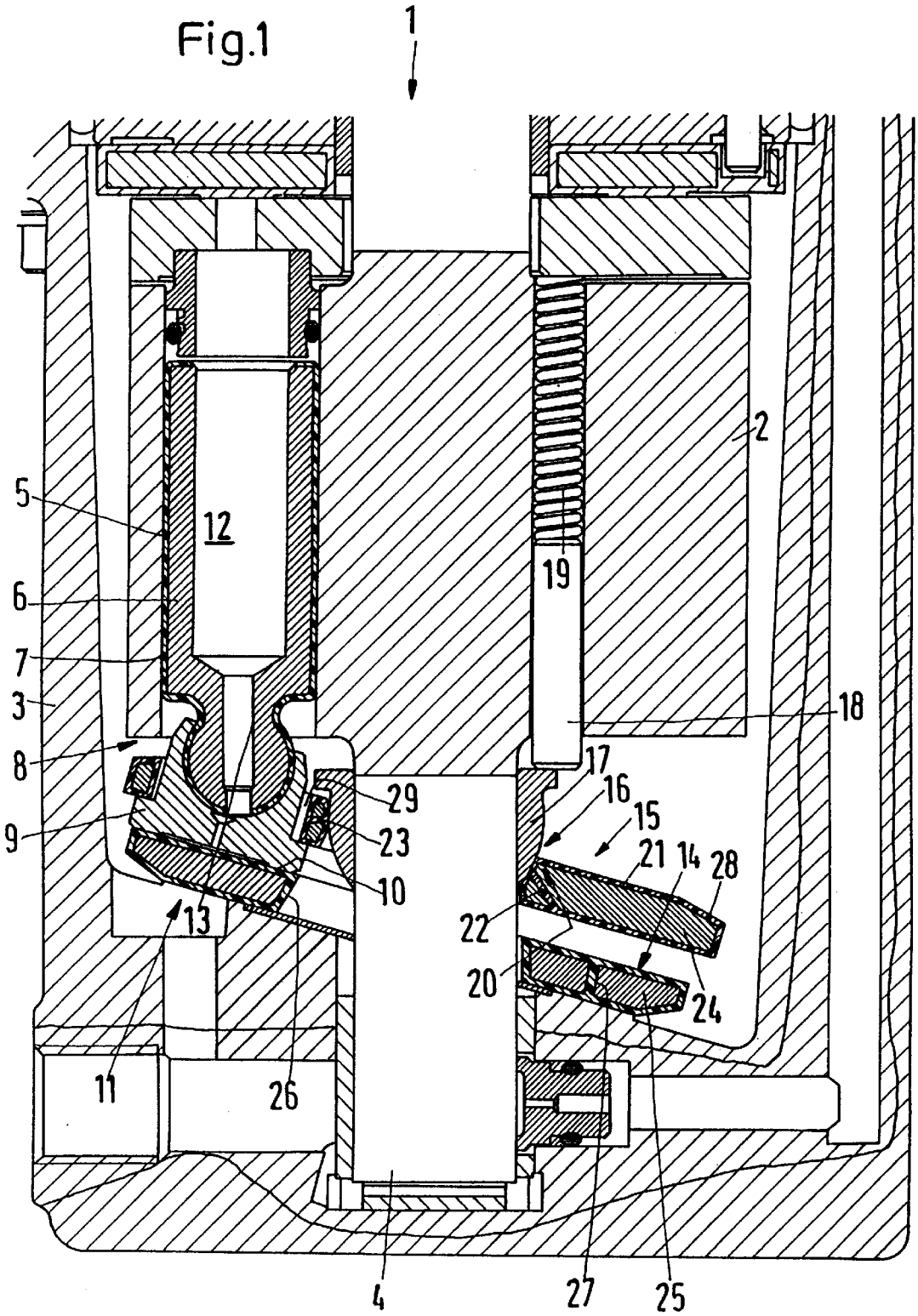
FIG. 1 is a diagrammatic cross-sectional view through a hydraulic axial piston machine.

A hydraulic axial piston machine 1 has a cylinder drum 2 which is arranged in a housing 3 to rotate about a shaft 4. In the cylinder drum 2 there are arranged several cylinders 5, only one of which is illustrated. In each cylinder 5 a piston 6 is arranged to move back and forth. In this particular embodiment, the movement of the piston is an up and down movement. The piston 6 has a covering 7 of plastic material which co-operates with the material of the cylinder drum 2 to create little friction.

The piston 6 is joined, articulated, to a slide shoe 9 by way of a ball-and-socket joint 8. The slide shoe 9 lies with a sliding contact surface 10 on a swash plate 11. The sliding contact surface 10 is hydrostatically lubricated through a through-bore 12 in the piston which continues in the slide shoe 9 as a through-bore 13.

So that the slide shoe 9 is held in contact with the swash plate 11, or more accurately, the control surface 14 thereof, a pressure plate 15 which bears against the cylinder drum 2 by way of a ball-and-socket joint 16 is provided. The ball-and-socket joint 16 has a spherical member 17, for example of steel, which is biased through a pusher rod 18 by a spring 19 with a pressure force towards the swash plate 11. The pressure plate 15 lies against this spherical member 17 with a bearing surface 20 of corresponding but oppositely spherically convex or conical form.

The pressure plate 15 is completely covered with a layer 21 of a friction-reducing plastics material. The "friction-reducing" property is here with respect to the material of the spherical member 17 with which the plastics material co-operates with little friction.

Moreover, the plastic material of the layer 21 co-operates with little friction with the material of the slide shoe 9. In operation, the pressure plate 15 performs a constant pivoting movement with respect to the spherical member 17. The friction caused during this pivoting movement is kept low, however, by the low-friction sliding of the plastics material of the layer 21 on the spherical member 17. In operation there is also a slight relative movement between the slide shoe 9 and the pressure plate 15. This movement will result in likewise low frictional losses and correspondingly little wear by virtue of the plastics material of the layer 21.

As is apparent, the layer 21 of friction-reducing plastics material is not merely arranged completely around the pressure plate 15. It also has rivet-like connections 22, 23 between different sides of the layer 21 which pass through the pressure plate 15, or more accurately, through its core 24. These connections 22, 23 are primarily arranged so that at least one of their two ends supports the layer 21 at the regions where the main friction occurs. The connections 22, 23 also hold the layer 21 closely against the core 24 when the adhesive connection between the layer 21 and the core 24 is not optimally formed.

To produce the layer 21, the core 24 is simply inserted in an injection mould. The mould is closed and the plastics material that will later form the layer 21 is injected. This provides on the one hand an intimate connection between the layer 21 and the core 24 and on the other hand the desired external shape.

Similarly, the swash plate 11 has a core 25 which is surrounded by a layer 26 of a friction-reducing plastics material. This plastics material can be the same as in the layer 21. The main function of this layer 26 is to allow the slide shoes 9 to slide with little friction, that is, without appreciable frictional losses and without corresponding abrasion or with little wear. In this manner it is possible to use even hydraulic fluids which have no or only poor lubricating properties, such as water, for example.

Rivet-like connections 27 can also be used in the construction of the swash plate. A connection between the upper side and underside is shown. These connections 27 can also be produced by injection-moulding of the layer 26 if the core 25 of the swash plate 11 is previously provided with corresponding bores or through-openings.

The pressure plate 15 is bevelled on its upper side, that is, it has a bevelled region 28. This bevelled region commences beyond a radius on which the midpoints of the through-openings 29, through which the slide shoes 9 pass, lie. But the region 28 starts at any rate still within a circular ring which is defined by the outermost points of the through-bores 29. The point of application of force transmission from the pressure plate 15 to the slide shoe 9 thus lies at any rate still out of the bevelled region 28, that is, in the region in which the thickness of the pressure plate 15 is still at its greatest. This construction enables the pressure plate to be made relatively thick, whilst at the same time enabling it to be taken relatively close to the cylinder drum 2 without risk of damage to the plastics material layer 21 by accidental contact between pressure plate 15 and cylinder drum 2.

As is apparent, the layer 21 on the core 24 of the pressure plate 15 and the layer 26 on the core 25 of the swash plate 11 can be fixed to relatively large flat areas. This facilitates application and also allows relatively large retaining forces between the layers 21, 26 and the cores 24, 25.

The slide shoes follow an elliptical orbit during operation. Because of this orbit configuration, the through-openings 29 must normally be relatively large when they have a circular area. This leads to the slide shoe 9 normally being held only at a relatively narrow region.

Figure 4:
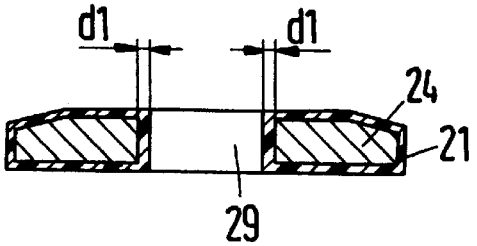
FIG. 4 shows a section IV—IV according to FIG. 2.
Figure 2:
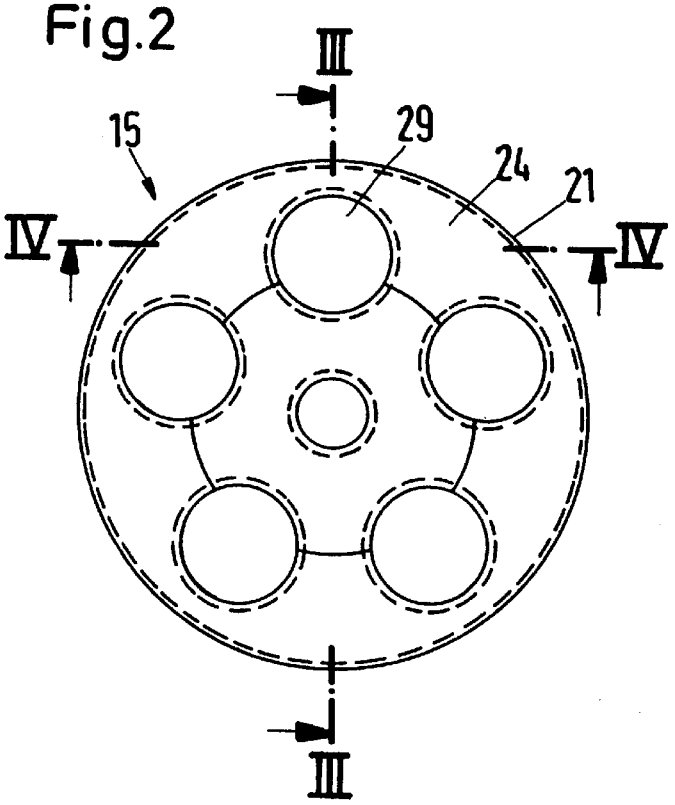
FIG. 2 is a diagrammatic plan view of a pressure plate.
Figure 3:
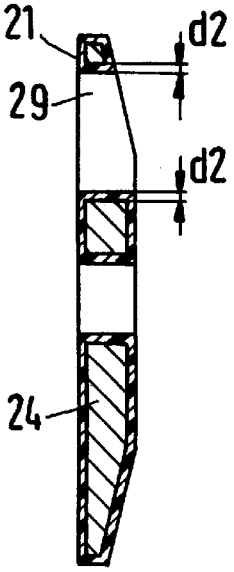
FIG. 3 shows a section III—III according to FIG. 2

For that reason, in the construction illustrated in FIG. 2, where the core 24 is illustrated by broken lines, the core 24 is constructed with circular through-openings 29 which, as is customary, can be made by drilling. The layer 21 of the friction-reducing plastics material varies, however, in thickness circumferentially inside the bores, however, that is, on the circumferential surface thereof. In the section IV—IV, which is illustrated in FIG. 4, the layer has a thickness d1, for example, whilst in a view rotated through 90° (FIG. 3) it has a thickness d2, d1 being greater than d2. This produces an elliptical construction of the through-openings 29, the long dimension of the ellipse being oriented radially with respect to the pressure plate 15. The region applying pressure to the slide shoes 9 enlarges accordingly. This in turn leads to a lower surface pressure between pressure plate and slide shoe and thus to reduced wear.

The elliptical form of the through-opening 29 can easily be achieved during moulding of the layer 21.

The mould merely needs to be of appropriate construction.

We claim:

1. A hydraulic piston machine having a cylinder body having at least one cylinder in which a piston is arranged to move back and forth, the piston bearing by way of a slide shoe against a control surface, and having a pressure plate which holds the slide shoe in engagement with the control surface, at least one of the pressure plate and a swash plate having the control surface having a layer of a friction-reducing plastics material with at least one of the pressure plate and the swash plate being sheathed in the friction-reducing plastics material.

2. A machine according to claim 1, in which the layer is injection-moulded onto the pressure plate and the control surface.

3. A machine according to claim 3, in which the pressure plate is bevelled proximate its edge on its side facing towards the cylinder body.

4. A machine according to claim 3, in which the bevelled edge commences in a radial direction within a circular ring in which through-openings for receiving the slide shoes are located.

5. A machine according to claim 4, in which the bevel commences inside a radius on which midpoints of the through-openings are located.

6. A machine according to claim 1, in which the layer has an interlocking connection with at least one of the pressure plate and the control surface.

7. A machine according to claim 6, in which at least one of the pressure plate and a swash plate including the control surface has a through-opening through which the plastics material extends.

8. A machine according to claim 6, in which the connection is located proximate the control surface.

9. A machine according to claim 1, including through-openings of elliptical shape in said pressure plate.

10. A machine according to claim 9, in which the pressure plate includes a core with circular bores having circumferential walls which are lined with the layer of friction-reducing plastics material to form the elliptical shape.

* * * * *